United States Patent [19]

Eichmann

[11] Patent Number: 4,466,745

[45] Date of Patent: Aug. 21, 1984

[54] CASING FOR A WATCH TO BE WORN ON THE BODY

[75] Inventor: Jean E. Eichmann, Onex-Geneva, Switzerland

[73] Assignee: Heinz Hermann Weick, Geneva, Switzerland

[21] Appl. No.: 317,488

[22] Filed: Nov. 2, 1981

[30] Foreign Application Priority Data

Nov. 3, 1980 [CH] Switzerland ..... 8142/80

[51] Int. Cl.[3] ..... G04B 37/00

[52] U.S. Cl. ..... 368/281; 368/285; 224/177

[58] Field of Search ..... 368/276, 277, 281, 282, 368/285, 301, 302, 303, 304, 305, 306, 307; 24/265 B, 265 WS; D10/30, 31, 32, 38; 224/164–177

[56] References Cited

U.S. PATENT DOCUMENTS

| | | | |
|---|---|---|---|
| 2,344,422 | 3/1944 | Sickinger | 368/282 |
| 2,775,861 | 1/1957 | Fachon | 368/282 |
| 3,165,884 | 1/1965 | Gwinner et al. | 368/282 |
| 4,231,502 | 11/1980 | Meyerson | 224/177 |
| 4,266,326 | 5/1981 | Hong | 224/177 X |

FOREIGN PATENT DOCUMENTS

| | | | |
|---|---|---|---|
| 933969 | 8/1963 | United Kingdom | 224/177 |

*Primary Examiner*—Vit W. Miska

*Attorney, Agent, or Firm*—Fleit, Jacobson, Cohn & Price

[57] ABSTRACT

In watches to be worn on the body, the support member such as a wrist strap or neck band often is secured to the watch by means of a connecting member at a distance from the periphery of the watch casing. Generally tongue portions are formed on the watch casing and the connecting members fitted thereto and secured against movement in a direction opposite to the fitting direction by complex means such as screw and springs. In the improved watch casing of the invention, tongue portions (1*a*) are formed on the casing shell (1). The connecting members (4) which can be fitted from above engage into recesses in the tongue portions and are thereby secured in position transversely with respect to the direction of fitting. The ends of the tongue portions extend over fixing axis members (6) which are fitted after positioning of the connecting members (4) between the members 4 and 6 so that the fixing axis members (6), and the loop portions (5*a*) of the wrist strap or bracelet which pass therearound, automatically secure the connecting members (4) in position in a direction opposite to the fitting direction.

4 Claims, 8 Drawing Figures

Fig.1
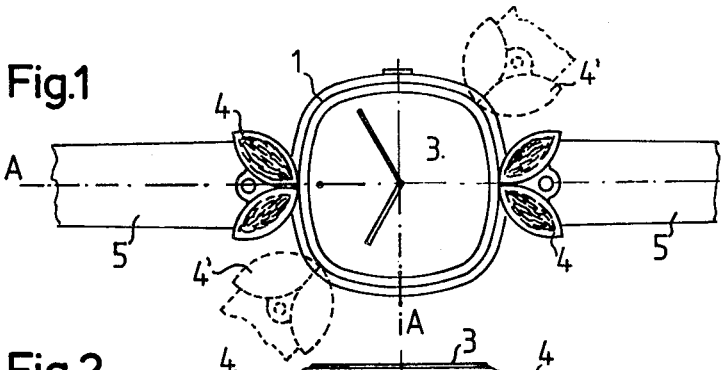
Fig.2
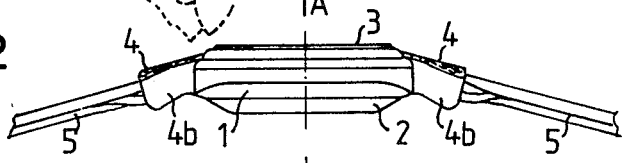
Fig.3
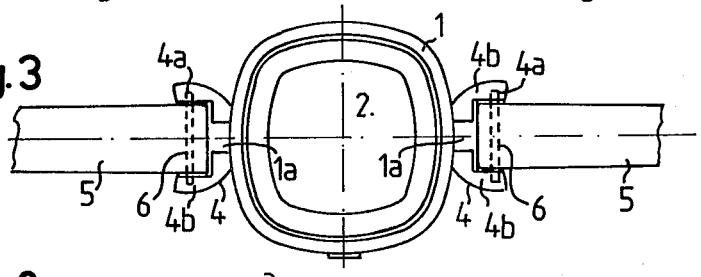
Fig.8
A-A
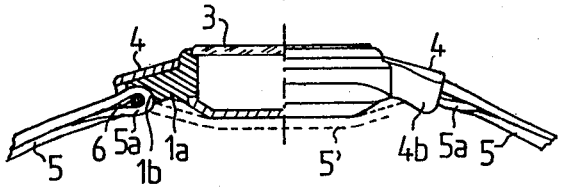
Fig.4
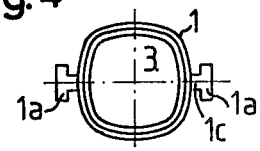
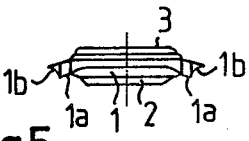
Fig.5
Fig.6
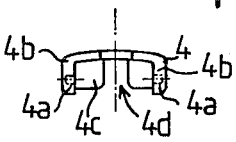
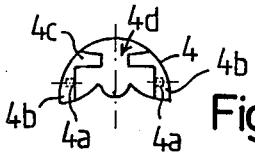
Fig.7

CASING FOR A WATCH TO BE WORN ON THE BODY

FIELD OF THE INVENTION

This invention relates to a casing for a watch to be worn on the body.

BACKGROUND OF THE INVENTION AND PRIOR ART

Watch support members such as a strap, neck chain or the like are generally secured directly to the casing shell in the peripheral region of the casing of the watch. However, in the case of fashion watches or decorative watches, a different construction from that construction just described is frequently used, insofar as the means for connecting the support member to the watch are disposed only at a certain radial distance from the outside edge of the watch casing. For that purpose, one or two connecting limb portions are arranged on the casing shell, depending on whether the watch is a wristwatch or a pendant watch. The connecting portions may be of a decorative configuration, thereby providing a considerably wider range of possible configurations in the overall design of the watch, than when the fixing means are provided directly on the watch casing.

However, in regard to fashion and decorative watches, there is a desire for individuality. In order to meet that need, the manufacturer endeavours to offer as large a number as possible of variations of different configuration of a given type of watch. While using a casing design which is otherwise the same, that aim can be achieved by the connecting portions being of a different configuration while however always being adapted to the form of the casing. In this connection, particularly in regard to casings which are produced by injection moulding or pressing processes, it is undesirable for the connecting limb portions to be formed directly on the casing shell as that presupposes an expensive tool for producing each variation of the basic design.

This expense is avoided for example by the connecting limb portions being subsequently soldered to the casing. In order to avoid the need for the soldering operation, the attempt has already been made to produce the connecting limb portions in the form of replaceable connecting members, and for only one or two radially outwardly projecting tongue portions which are independent of the design of the connecting members to be formed directly on the casing shell. The tongue portion and the connecting member have mutually interengaging means which permit the connecting member to be fitted on to the watch from the top side thereof. However, a serious disadvantage of this arrangement is that the connecting member can only be secured in position, in the opposite direction to the direction of fitting, as is necessary, by using excessively expensive means, or even in an unrealistic manner. A first proposal in this respect provides for using expensive screw means. Another proposal in this respect provides a leaf spring detent means which, because of the small amount of space available, can hardly be produced in a functionally efficient manner, even when investing in a disproportionately high level of precision.

OBJECT OF THE INVENTION

An object of the invention is to provide a means of fixing a connecting member in position on a watch casing tongue portion, in the opposite direction to its direction of fitting, by means which are inexpensive, reliable and both quick and easy to handle.

SUMMARY OF THE INVENTION

Accordingly the present invention provides a casing for a watch which is to be worn on the body, having at least one fixing axis member, which is arranged removably in the peripheral region of the casing, for a support member for carrying the watch on the body, which fixing axis member is removably mountable on a connecting member which is removably fitted from the top of the casing on to a tongue portion arranged laterally on the peripheral region of the casing, and which is secured in position transversely with respect to the direction of fitting by complementary shaped surfaces provided on the connecting member and on the tongue portion, wherein at least the end region of the connecting member which is remote from the watch casing and which carries the fixing axis member for the support member has an open mouthed substantially channel shaped cross-section which opens downwardly, when fitted on the tongue portion, towards the bottom of the tongue portion and casing, and wherein the end region, which is remote from the watch casing, of the tongue portion operatively extends below the middle or base portion of the channel-shaped connecting member end region at least over the fixing axis member to secure the connecting member to the tongue portion in a direction opposite to the direction in which it is fitted on the tongue member.

Other objects and features of the invention will become apparent from the following detailed description of preferred but non-limitative embodiments and the accompanying drawing made a part hereof and to which reference is made.

BRIEF DESCRIPTION OF THE DRAWINGS

FIG. 1 shows a plan view of a wristwatch according to the invention,

FIG. 2 shows a side view,

FIG. 3 shows a view of the bottom of the watch,

FIG. 4 shows a plan view of the watch casing,

FIG. 5 shows a side view of the watch casing,

FIG. 6 shows a side view of a connecting member which is formed as a push-on cap (on to the outer end region which has the strap or bracelet connecting means), FIG. 7 shows a view from below of the cap shown in FIG. 6, and FIG. 8 shows a side view corresponding to the view shown in FIG. 2, with the casing partly in section (without the watch mechanism).

A watch casing comprises a watch shell 1 and a bottom cover member 2. A cover glass is indicated by reference numeral 3. Formed on the watch shell 1, at the periphery thereof, are two diametrically oppositely disposed, radially outwardly projecting tongue portions 1*a* of T-shaped configuration in plan view. On the underside, the transverse portions of the T-shape are delimited by arcuate surfaces 1*b* whereby the tongue portions 1*a* taper towards their ends which are remote from the casing.

The connecting members 4 are in the form of push-on caps. Fixing axis members 6 which are of a telescopically resilient construction are used in known manner as fixing means for the support member 5 which is in the form of a strap or bracelet; the ends of the fixing axis members 6 being mounted in blind bores 4*a* in the side walls 4*b* of the caps 4. A downwardly open slot 4*d* is provided in the wall 4*c* of the caps 4, which is towards the watch casing.

When the fixing axis member 6 is removed, the caps 4 are fitted on to the T-shaped tongue portions from the top side of the watch. The longitudinal portions 1*c* of the T-shapes of the tongue portions 1*a* thus slide into the slots 4*d*, while the transverse portions of the T-shape are received within the caps 4. The caps are thus secured in position transversely with respect to the direction of fitting. As can be seen in particular from FIG. 8, the tapered end regions of the tongue portions 1*a* project at a certain distance over and beyond the subsequently fitted fixing axis members 6 around which pass loop portions 5*a* of the strap or bracelet. The distance between the fixing axis members 6 and the delimiting surfaces 1*b* of the tongue portions 1*a*, which surfaces extend concentrically with respect to the members 6, is so selected that the corresponding regions of the loop portions 5*a* bear against said surfaces. In this way, the cap 4 is secured in position in the opposite direction to its direction of fitting, as is required, by the means for fixing the loop portions 5*a*, which are required in any case, without the need for additional means and a special working operation.

Instead of the T-shape of the tongue portions 1*a*, which is advantageous in itself, and the identical but opposite configuration of the caps the mutual interengagement in regard to both these members can also be produced by another identical but opposite configuration. Thus for example it is possible for the caps to be caused to engage into a bore in the tongue portions, with a pin-like internal projection.

FIG. 8 also indicates in broken lines that a one-piece strap or bracelet 5' can also extend between the two fixing axis members 6, at the rear of the watch.

When the watch casing is of a square or rectangular shape, as shown in FIG. 1, it is also possible for the connecting members 4' to be arranged on a diagonal of the casing.

If the watch is in the form of a pendant, then a short loop can first be fixed to the watch by means of the fixing axis member 6 in the above-described manner and then for example a chain or a neck band can be passed through the abovementioned short loop. Alternatively however, a carrier member of neck band type can be fixed directly to the watch.

If one type of housing is to be used both for a wristwatch and also as a pendant watch, there are a number of possible ways in which the push-on cap of the fixing means which is not used in the case of the last-mentioned mode of use can be positively secured in position. Thus for example the corresponding fixing axis member can be formed of larger diameter, or can be surrounded by a sleeve. The cross-section thereof may be such that the free space around the fixing axis member 6 in the cap is completely filled in an aesthetically attractive manner.

I claim:

1. A casing for a watch which is to be worn on the body, said casing comprising:

a watch shell in the form of a ring including a tongue portion extending outwardly from the periphery of the shell;

a support member for carrying the watch on the body, said support member having an end;

a fixing axis member for receiving and engaging the end of the support member;

a connecting member which is removably fitted from the top of the shell to said tongue portion in overlying relationship therewith and which is secured in position transversely with respect to the direction of fitting by complementary shaped surfaces provided on the connecting member and on the tongue portion, said connecting member having a pair of spaced, depending side walls to surround said tongue portion and to define a slot to receive a longitudinal portion of said tongue portion, said side walls each having an inwardly facing blind bore, the blind bores being coaxial to receive said fixing axis member, wherein at least the end region of the connecting member which is remote from the watch shell and which carries the fixing axis member for the support member has an open mouthed, substantially channel shaped cross section which opens downwardly when the connecting member is fitted on the tongue portion, towards the bottom of the tongue portion and casing, and wherein the end region of the tongue portion remote from the watch shell operatively extends into the channel-shaped cross section of the connecting member and at least partially overlies the fixing axis member to secure the connecting member to the tongue portion in a direction opposite to the direction in which it is fitted on the tongue member.

2. A casing according to claim 1, in which the end region of the tongue portion, which is operatively adjacent to the fixing axis member, has an outwardly tapered end in the form of an inclined surface which is formed thereon on the side which faces towards the fixing axis member.

3. A casing according to claim 2, in which the inclined surface operatively extends in a curved configuration substantially concentrically with respect to the fixing axis member.

4. A casing according to claim 1, in which the connecting member is in the form of a push-on cap having an open mouth operatively directed towards the underside of the casing tongue portion, which cap has, on the side for carrying the fixing axis member, a side wall which operatively faces towards the casing of the watch and defines a T-shaped opening which operatively opens towards the underside of the casing, the casing tongue portion having a substantially T-shaped configuration as viewed from the top of the casing, for engaging in the T-shaped opening in the cap and projecting into the cap.

* * * * *